US009435171B1

(12) United States Patent
Johnson

(10) Patent No.: US 9,435,171 B1
(45) Date of Patent: Sep. 6, 2016

(54) REMEDIATION PACKER

(71) Applicant: Jason B. Johnson, Greensboro, NC (US)

(72) Inventor: Jason B. Johnson, Greensboro, NC (US)

( * ) Notice: Subject to any disclaimer, the term of this patent is extended or adjusted under 35 U.S.C. 154(b) by 287 days.

(21) Appl. No.: 14/205,582

(22) Filed: Mar. 12, 2014

(51) Int. Cl.
*E21B 33/12* (2006.01)

(52) U.S. Cl.
CPC ..... *E21B 33/12* (2013.01)

(58) Field of Classification Search
CPC ..... B09B 1/006; E21B 21/00; E21B 41/005
See application file for complete search history.

(56) References Cited

U.S. PATENT DOCUMENTS 6,041,863 A * 3/2000 Lindsey ..... B09C 1/002 166/187

* cited by examiner

*Primary Examiner* — William P Neuder
(74) *Attorney, Agent, or Firm* — Blake P. Hurt; Tuggle Duggins P.A.

(57) ABSTRACT

A remediation packer assembly including an inlet pipe defining a plurality of radially-oriented inlets and attached at opposing ends to stinger pipes with wrap sleeves positioned thereon. The assembly may be inserted into a monitoring pipe and inserted into a substrate, for example a well, for the collection of free product in a fluid or unsaturated environment. For example, the remediation assembly is inserted into the well until the collection zone as defined by the wrap sleeves is in planar orientation with the free product, and in the case of vacuum remediation, the free product is removed from the fluid column and brought to the surface where it may be processed and removed. A method of remediating the substrate is also provided.

19 Claims, 4 Drawing Sheets

REMEDIATION PACKER

FIELD OF THE INVENTION

The invention herein pertains to well and other bore-hole packers and particularly pertains to remediation assemblies for radial removal and internal specific recovery of free product and other phase contaminants from monitoring wells, extraction wells, and other fluid-containing environments.

DESCRIPTION OF THE PRIOR ART AND OBJECTIVES OF THE INVENTION

Ground environmental remediation efforts typically focus on the removal of contaminants and pollutants from the groundwater, soil, sediment, surface water, and the like. Other times, fluids such as air or water may be introduced or injected back into a subterranean cavity. Often, ground remediation is focused to a well or similar environment, wherein the remediation of the well is for the general protection of human health and environmental protection or rehabilitation. Remediation efforts are increasingly subjected to an array of governmental and industrial regulatory requirements, such as EPA Regulations 40 CFR 280, 281, and 282 which are incorporated by reference herein in its entirety. In a conventional well environment (as shown in FIG. 1), a hole is drilled to a predetermined depth and a casing is positioned within the well bore. The casing may be formed from PVC or metal and is positioned in the well bore as is known in the art. In monitor or extraction well applications, a passageway may be defined through the casing and into the strata, thereby allowing fluids such as water, hydrocarbons or the like to flow into the casing through openings, perforations, or other apertures formed therein. This casing may be referred to as a monitoring well (see FIG. 1). In most cases, impermeable inserts such as a bentonite layer and permeable inserts such as a sand filter pack may be positioned around the casing for well structural support as well as an attempt to block large particulates from accessing the well.

Remediation of a well is often difficult and demanding work. Remediation methods include vacuum, air sparging, and injection remediation and each may utilize vacuum or other pumps in the pumping and treatment of contaminated groundwater. Typically, the extracted groundwater is purified via mechanical and biological methods which may remove and/or absorb undesirable contaminants in the groundwater. However, conventional vacuum pump and treatment systems are often inefficient, costly, labor-intensive and timely endeavors. For instance, it is not uncommon to remediate a water well with petroleum products, and in particular to attempt to filter the petroleum free product in an effort to purify the groundwater using traditional systems and methods. Therefore, packers have been used to assist in the collection, removal, addition, or filtration of fluids such as water, air, and the like. Typically, a temporary packer is delivered down a well via an elaborate conveyance and expansion system. However, even with the aid of these demanding conveyance and expansion packer systems, conventional pumps and treatment of well environments is a difficult and expensive process. Alternatively, permanent packers may be inserted into the well that use ribs or other frictional engagement means to seal the well and allow vacuum. These devices are expensive and cannot be recovered from the site once the remediation is complete.

It is often very difficult to ascertain the level of contamination in a given column of fluid, which may lead to repositioning the packer several times before the correct level is determined. Remediation is conventionally accomplished by pulling fluid through a terminal end of a recovery pipe (sometimes referred to as a "stinger" pipe) which may include a filtering device, screen, or the like. This leads to a cone of depression resulting in over-inclusive and inefficient fluid removal, short-circuiting, and filtration, further leading to increased time and cost of a given remediation project.

Thus, in view of the problems and disadvantages associated with prior art devices, the present invention was conceived and one of its objectives is to provide a remediation assembly for radially removing free product or other contaminants from a specific interval in a well or fluid column.

It is another objective of the present invention to provide an adjustable remediation assembly including a pipe with a plurality of inlet draws with a pair of wrap sleeves opposingly positioned above and below the radial collection zone.

It is still another objective of the present invention to provide a remediation assembly with a plurality of adjustable clamps for securing the sleeves to the pipe.

It is yet another objective of the present invention to provide a remediation assembly with an internal monitoring pipe screen, sleeves with an inlet screen to recover the fluid under vacuum.

It is a further objective of the present invention to provide a multi-use remediation assembly capable of vacuum, air sparging, and injection remediation.

It is still a further objective of the present invention to provide a remediation assembly configured to radially collect petroleum product or vapors in planar orientation to the collection zone, the collection zone adjustably defined via the packer sleeves and adjustable clamps.

It is yet a further objective of the present invention to provide a remediation assembly in fluid communication with a vacuum system, pump system, or a fluid-introduction system.

It is a further objective of the present invention to provide a remediation assembly that can conduct a remediation operation and thereafter be removed from the project location without substantial time, expense, and expertise.

It is another objective of the present invention to provide a remediation packer that is inexpensive to manufacturer and simple to use such that it can be disposed after a single use.

It is still a further objective of the present invention to provide a method of utilizing a radially collecting vacuum remediation packer with easily adjustable expansion zones that define a collection zone to capture contaminants and free product from a well or other fluid environment.

Various other objectives and advantages of the present invention will become apparent to those skilled in the art as a more detailed description is set forth below.

SUMMARY OF THE INVENTION

The aforesaid and other objectives are realized by providing a remediation packer assembly configured for use during vacuum remediation, injection remediation, and sparging remediation. The assembly includes an inlet pipe defining a plurality of radially-oriented inlets and is attached at opposing ends via male and female couplers to stinger pipes with petroleum-resistant wrap sleeves positioned thereon. Two or more adjustable clamps are used to affix the wrap sleeves to their respective stinger pipes, and the wrap sleeves in combination with the inlets define a radial collection zone for pulling fluids out of the remediated site for processing and disposal, for example water, petroleum, noxious vapor, or the like. The assembly may be inserted into a monitoring pipe and inserted into a substrate, for example a water well, for the collection of free product in a fluid environment. The remediation assembly is inserted into the well until the collection zone as defined by the wrap sleeves and inlets is in planar orientation with the free product or area of concern, and in the case of vacuum remediation, the free product is removed from the fluid column and brought to the surface where it may be processed and removed. A method of remediating the substrate is also provided.

DETAILED DESCRIPTION OF THE PREFERRED EMBODIMENT AND OPERATION OF THE INVENTION

Figure 1:
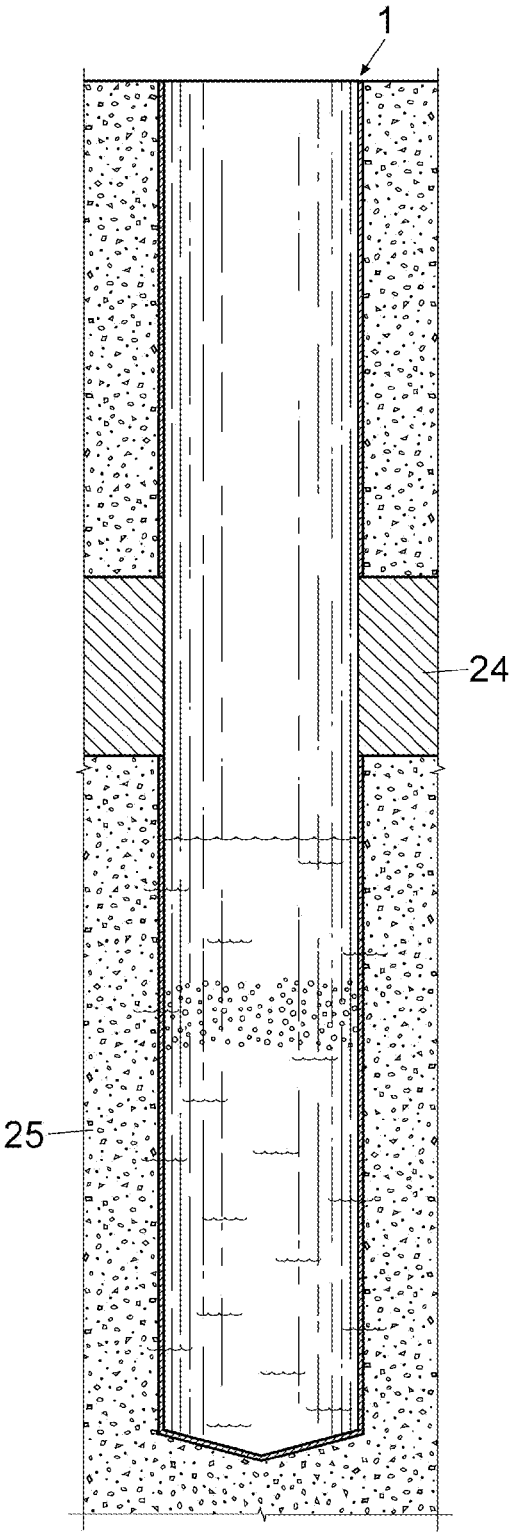
FIG. 1 demonstrates an elevated side view of a conventional monitoring well.
Figure 2:
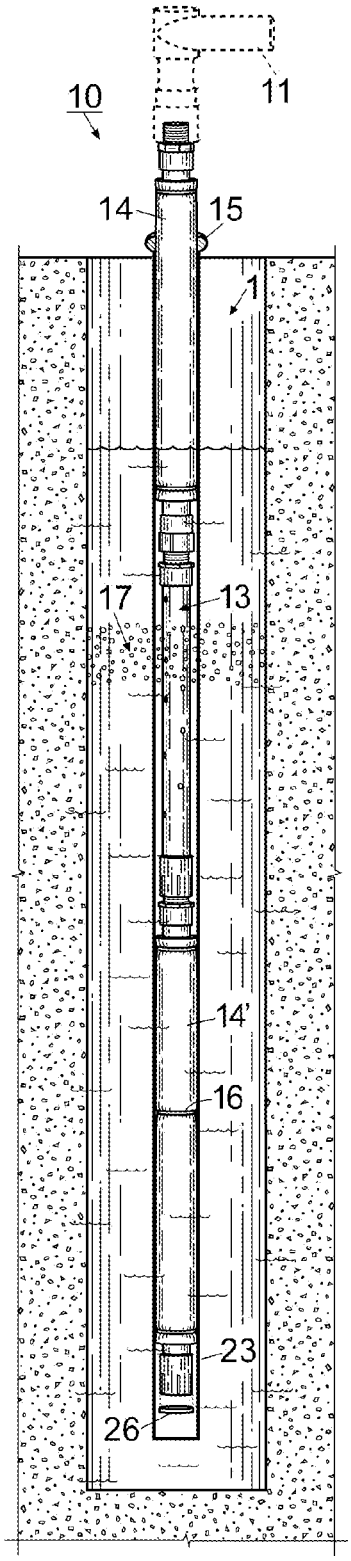
FIG. 2 shows an elevated side view of a remediation packer in communication with an optional vacuum system in the well of FIG. 1, the opposing side being a mirror image thereof.

For a better understanding of the invention and its operation, turning now to the drawings, FIG. 2 illustrates schematically an elevated side view of remediation packer assembly 10 positioned in a operating environment such as well 1 and in communication with vacuum system 11, illustrated with dotted lines. As is known in the art, well 1 as also shown in FIG. 1 may be bore into a fluid-containing substrate, forming an aperture to insert packer assembly 10 therein, for example in a water-containing well or the like. In most cases, impermeable inserts such as bentonite layer 24 and permeable inserts such as sand filter pack 25 may be positioned around monitoring well 1 for well structural support as well as an attempt to block large particulates from accessing the well.

Remediation packer assembly 10 includes stinger pipe sections 12, 12' which are connected at either end of inlet pipe 13. At least one of a plurality of wrap sleeves 14, 14' are attached to each of stinger pipe sections 12, 12' and in opposing relation thereon. Preferred remediation packer assembly 10 includes monitoring well 15, which is positioned in well 1 for maintaining the structural integrity of well 1 and to receive stinger pipe sections 12, 12' and frictionally engages wrap sleeves 14, 14' to create a beneficial pressure differential for remediation during operation of vacuum system 11. Monitoring well 15 may also define annular space between the wall of well 15 and the wall of well 1. This space may include sand or other porous, filtering material located immediately distal the walls of well 15 which filters out particulates prior to processing by remediation packer assembly 10. Monitoring well 15 also preferably includes screened interval 23 that permits water and vapor as well as free product to be drawn through inlet pipe 13 and transported to the surface for recovery, processing, and disposal.

Figure 3:
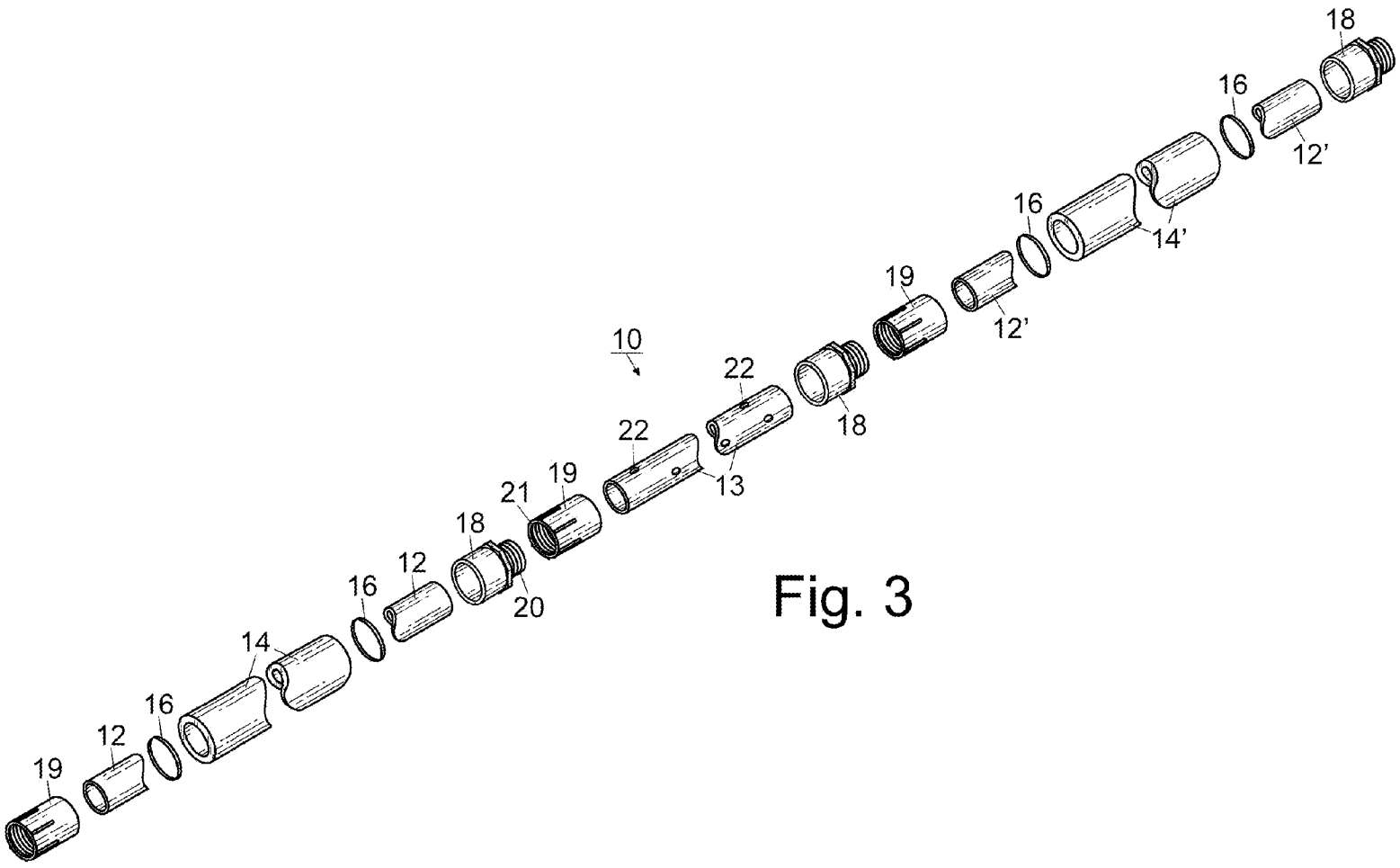
FIG. 3 pictures an exploded perspective side view of the remediation packer of FIG. 2.

FIG. 3 shows a side perspective view of remediation packer assembly 10 with the various components exploded therefrom. Wrap sleeves 14, 14' are preferably formed from cylindrical petroleum-resistant polyethylene, nitrile, or neoprene but may be formed from any material that can encase stinger pipe sections 12, 12' and frictionally engage monitoring well 15 to provide a beneficial pressure differential during vacuum remediation. Sleeves 14, 14' may be longitudinally adjusted along stinger pipe sections 12, 12' to define a radial collection zone 17 to focus remediation efforts at an isolated zone of interest proximate screened interval 23, thereby avoiding unnecessary remediation resources and time. Although two wrap sleeves 14, 14' are shown in FIGS. 2 and 3, a greater number of sleeves 14 may be deployed during remediation packer assembly operation to alter the size and shape of collection zone 17 as dictated by the size, shape, and environment of well 1. For example, collecting free product at radial collection zone 17 minimizes excessive fluid processing and recovery while reducing the time and cost associated with a specific remediation project. Preferably, wrap sleeves 14, 14' define upper and lower expansion zones and are oriented such that collection zone 17 is positioned in a planar orientation to the target fluid containing the free product to be remediated and any escape, short-circuiting or leakage is prevented by the respective expansion zones. Free product-containing fluid is drawn through screened interval 23 and is directed towards inlets 22 by wrap sleeves 14, 14'.

Figure 4:
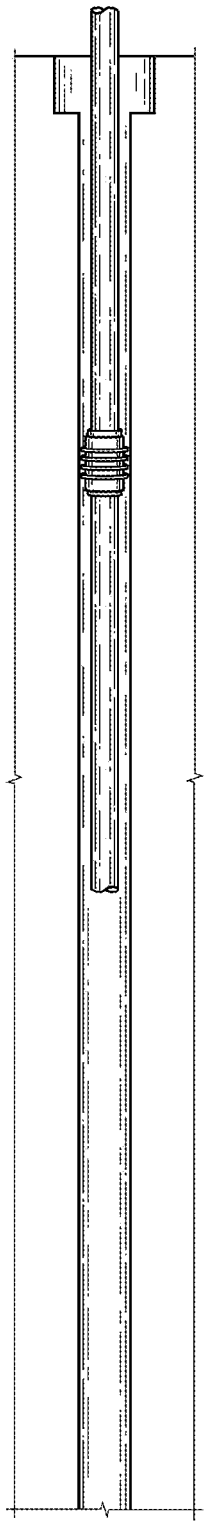
Fig. 4 Prior Art
FIG. 4 depicts a prior art remediation packer.

One or more wrap sleeves 14, 14' may be adjustably affixed to different ones of stinger pipe sections 12, 12' with a variety of fasteners, zip ties, adhesives, and the like, but are preferably attached with a plurality of metallic, screw-driven circular clamps 16. Clamps 16 may be longitudinally spaced along the length of wrap sleeves 14, 14' before remediation packer assembly 10 is inserted into well 1 for use. By positioning, loosening, or tightening clamps 16 on wrap sleeves 14, 14', a user may adjust the size, shape, and orientation of collection zone 17, as well as alter the pressure differential as experienced at collection zone 17. This adjustability affords increased flexibility to remediation packer assembly 10 over prior art devices that have a fixed draw depth and collection zone pressure such as the one shown in FIG. 4. The size, shape, and orientation of sleeves 14, 14' may also be adjusted to ensure that collection zone 17 is in planar orientation with the free product or interval desired to be collected. During operation, planar orientation of collection zone 17 with the level of free product, for example a layer of petroleum free product, significantly reduces the amount of fluid that need be filtered to complete the remediation of a given well, leading to savings in cost and time.

Preferred remediation packer assembly 10 includes a plurality of male couplers 18 and female couplers 19 to attach inlet pipe 13 to stinger pipe sections 12, 12'. In one or more embodiments of remediation packer assembly 10, male couplers 18 and female couplers 19 may also be utilized to connect additional inlet pipes 13 for multiple collection zones 17, additional stinger pipe sections 12, 12' for extending remediation packer assembly 10 into deeper wells, or to vacuum assembly 11 for vacuum remediation. Male couplers 18 and female couplers 19, along with cap 26 (FIG. 2) are configured to assist in maintaining a beneficial pressure differential at collection zone 17 by ensuring that no pressure release takes place between the portion of remediation packer assembly 10 proximal the surface and collection zone 17. While this may be accomplished in a variety of ways, preferred male coupler 18 defines threaded end 20 that is sized to be received within threaded receiver 21, defined in preferred female coupler 19. The opposing ends of male coupler 18 and female coupler 19 are sized and shaped to receive the diameter of a pipe therein, for example stinger pipe sections 12, 12' or inlet pipe 13, respectively. In use, the pipe engages male coupler 18 or female coupler 19, for example frictionally or with the use of an adhesive. Threaded end 20 is inserted into threaded receiver 21 and rotated until a seal is formed between male coupler 18 and female coupler 19, preferably tight enough such that no fluid escapes from the joint. This tight engagement may include washers, gaskets, or the like and ensures that no pressure drops during vacuum remediation, no air escapes during sparging remediation, and no chemicals escape during injection remediation, as well as no pollutants are released during well water remediation.

A method of remediating a fluid environment such as a well includes providing remediation packer assembly 10 with inlet pipe 13 which defines a series of radially oriented inlets 22 and is attached at opposing ends to different ones of stinger pipe sections 12, 12' via male threaded couplers 18 and female couplers 19, respectively. A plurality of circular clamps 16 are utilized to secure wrap sleeves 14, 14' to different ones of stinger pipe sections 12, 12' to ensure the appropriate pressure differential is maintained at collection zone 17 created by vacuum system 11 and inlets 22 and adjustably positioned in planar orientation to the free product to be remediated are also provided. Well 1 is bored out of a fluid-containing substrate, and monitoring pipe 15 is inserted therein, defining annular space between the walls of well 1 and monitoring pipe 15. The depth of the free product-containing fluid is determined, and the clamps 16 and wrap sleeves 14, 14' are oriented to define collection zone 17 in planar orientation to that predetermined depth. Remediation packer assembly 10 is inserted into well 1 within monitoring pipe 15 such that wrap sleeves 14, 14' are in tight frictional engagement with monitoring pipe 15 and collection zone 17 is positioned in planar orientation with the fluid to be remediated. Vacuum system 11 is engaged, and the negative pressure within remediation packer assembly 10 draws fluid and free product through inlets 22 and to the surface, where the free product is separated and discarded. In an alternate embodiment of remediation packer assembly 10, filters may be placed in the annular spaces formed between well 1 and monitoring pipe 15 or in collection zone 17 over inlets 22 to strain particulates such as sediment from the remediated fluid (not shown).

A method of remediating an environment such as a well includes providing a remediation packer assembly with inlet pipe which defines a series of inlets 22 and is attached at opposing ends to different ones of stinger pipe portions 12, 12' via male threaded couplers 18 and female couplers 19, respectively. A plurality of circular clamps 16 to secure wrap sleeves 14, 14' to different ones of stinger pipe portions 12, 12' to ensure the appropriate pressure differential is maintained is also provided. Well 1 is bored out of a substrate, and monitoring pipe 15 is inserted therein, defining annular space between the walls of well 1 and monitoring pipe 15. Remediation packer assembly 10 is inserted into well 1 within monitoring pipe 15 such that wrap sleeves 14, 14' are in tight frictional engagement with monitoring pipe 15. Remediation material, for example air sparging or chemicals, are then pumped through stinger pipe sections 14, 14' and released through inlets 22 in inlet pipe 13. The frictional engagement of sleeves 14, 14' prevent backflow of the remediation material to the surface, increasing the efficiency of the remediation effort and reducing the time and cost associated therewith.

The illustrations and examples provided herein are for explanatory purposes and are not intended to limit the scope of the appended claims.

I claim:

1. A remediation packer assembly for remediating a well comprising an inlet pipe, said inlet pipe defining a plurality of radially oriented inlets, a stinger pipe, a wrap sleeve, said wrap sleeve positioned on said stinger pipe, said inlet pipe affixed to said stinger pipe, a clamp, said clamp engaging said wrap sleeve, whereby said remediation packer assembly is configured to radially remediate said well.

2. The remediation packer of claim 1 further comprising a vacuum system, said vacuum system in fluid communication with said stinger pipe.

3. The remediation packer of claim 1 further comprising a monitoring pipe, said monitoring pipe sized to frictionally engage said wrap sleeve.

4. The remediation packer of claim 1 further comprising a male coupler and a female coupler, said male coupler defining a threaded end, said female coupler defining a threaded receiver, said male coupler sized to engage said inlet pipe, said female coupler sized to engage said stinger pipe.

5. The remediation packer of claim 1 wherein said plurality of inlets define a collection zone.

6. The remediation packer assembly of claim 1 wherein said assembly is configured for injection remediation.

7. The remediation packer assembly of claim 1 wherein said assembly is configured for air sparging remediation.

8. The remediation packer of claim 1 wherein said wrap sleeve is formed from polyethylene.

9. A vacuum remediation packer assembly for collecting free product from a well comprising an inlet pipe, said inlet pipe defining a plurality of inlets, a pair of stinger pipes, each of said stinger pipes affixed at an opposing end of said inlet pipe, a vacuum system, said vacuum system in fluid communication with one of said stinger pipes, a pair of wrap sleeves, said wrap sleeves attached to different ones of said stinger pipes, said pair of wrap sleeves and said plurality of inlets adjustably defining a radial collection zone, whereby said vacuum remediation packer assembly is configured to radially remediate said well.

10. The remediation packer of claim 9 further comprising a monitoring pipe, said monitoring pipe sized to frictionally engage said wrap sleeves.

11. The remediation packer of claim 9 further comprising a first male coupler and a first female coupler, a second male coupler and a second female coupler, said male couplers each defining a threaded end, said female couplers each defining a threaded receiver, said first male and female couplers sized to engage said inlet pipe, said second male and female couplers sized to engage different ones of said stinger pipes.

12. The remediation packer of claim 9 further comprising a plurality of clamps, said clamps engaging each of said wrap sleeves.

13. The remediation packer of claim 9 wherein said wrap sleeves are formed from nitrile.

14. The remediation packer of claim 9 wherein said wrap sleeves are formed from neoprene.

15. A method of remediating a substrate comprising the steps of:

providing a remediation packer assembly including an inlet pipe defining a plurality of radially oriented inlets and attached at opposing ends to stinger pipes with one or more wrap sleeves positioned thereon, a monitoring pipe configured to receive said inlet pipe and said stinger pipes and sized to frictionally engage said wrap sleeves;

inserting the remediation packer assembly within a well; and radially remediating the well via the plurality of inlets.

16. The method of claim 15 wherein providing a remediation packer further comprises the step of providing a plurality of screw-driven clamps, said clamps adjustably positioned on said sleeves.

17. The method of claim 16 further comprising the step of adjusting said clamps on said wrap sleeves to define a collection zone.

18. The method of claim 17 further comprising the step of positioning said collection zone in planar orientation relative to a level of free product.

19. The method of claim 15 wherein providing wrap sleeves further comprises the step of providing wrap sleeves selected from the group nitrile, neoprene, or polyethylene.

* * * * *